US011918029B2

(12) United States Patent
Batista et al.

(10) Patent No.: US 11,918,029 B2
(45) Date of Patent: Mar. 5, 2024

(54) APPARATUS FOR CRIMPING A BAND OF MATERIAL

(71) Applicant: PHILIP MORRIS PRODUCTS S.A., Neuchatel (CH)

(72) Inventors: Rui Nuno Batista, Morges (CH); Pietro Davide LaPorta, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 192 days.

(21) Appl. No.: 17/269,606

(22) PCT Filed: Aug. 19, 2019

(86) PCT No.: PCT/EP2019/072106
§ 371 (c)(1),
(2) Date: Feb. 19, 2021

(87) PCT Pub. No.: WO2020/038869
PCT Pub. Date: Feb. 27, 2020

(65) Prior Publication Data

US 2021/0315254 A1 Oct. 14, 2021

(30) Foreign Application Priority Data

Aug. 21, 2018 (EP) ..... 18190087

(51) Int. Cl.
*A24B 3/14* (2006.01)
*A24D 3/02* (2006.01)

(52) U.S. Cl.
CPC ..... *A24B 3/14* (2013.01); *A24D 3/0204* (2013.01)

(58) Field of Classification Search
CPC ..... A24D 3/0204
(Continued)

(56) References Cited

U.S. PATENT DOCUMENTS 3,317,965 A 5/1967 Zenji
4,618,339 A 10/1986 Arthur
(Continued)

FOREIGN PATENT DOCUMENTS

CN 206927326 1/2018
EP 3136881 B1 * 11/2017 ..... A24B 15/16
(Continued)

OTHER PUBLICATIONS

First Office Action (CN) (Translated), dated Mar. 3, 2022 (Year: 2022).*
(Continued)

*Primary Examiner* — Philip Y Louie
*Assistant Examiner* — Miles A Simpson
(74) *Attorney, Agent, or Firm* — Mueting Raasch Group

(57) ABSTRACT

An apparatus (100) for crimping a band of material and a method of crimping and shaping a band of material is disclosed. The apparatus (100) comprising a crimping portion (1) comprising a first crimping roller (2) defining a first rotational axis and a second crimping roller (3) defining a second rotational axis, wherein the first and second crimping rollers are configured to allow a band of material to pass therebetween and towards an adjacent apparatus; and an adjustment portion (20) configured to adjust the position of at least one of the first and second rotational axes relative to the position of the adjacent apparatus to thereby adjust the tension in the band of material between the crimping portion and the adjacent apparatus.

14 Claims, 6 Drawing Sheets

(58) Field of Classification Search
USPC ..... 131/274
See application file for complete search history.

(56) References Cited

U.S. PATENT DOCUMENTS

| | | | |
|---|---|---|---|
| 5,466,209 | A | 11/1995 | Takegawa |
| 2014/0166032 | A1 | 6/2014 | Gindrat |
| 2017/0245542 | A1 | 8/2017 | Zappoli |

FOREIGN PATENT DOCUMENTS

| | | |
|---|---|---|
| EP | 3 473 113 | 4/2019 |
| EP | 3 473 133 | 4/2019 |
| GB | 1 463 114 | 2/1977 |
| WO | WO 2016/023965 | 2/2016 |
| WO | WO 2017/089545 | 6/2017 |
| WO | WO 2018/197353 | 11/2018 |

OTHER PUBLICATIONS

Search Report and Written Opinion for PCT/EP2019/072106 dated Nov. 13, 2019 (11 pages).
Extended European Search Report for Application No. 18190087.9 dated Mar. 14, 2019 (7 pages).
Office Action issued in China for Application No. 201980050311.X dated Mar. 3, 2022 (8 pages). English translation included.

* cited by examiner

APPARATUS FOR CRIMPING A BAND OF MATERIAL

This application is a U.S. National Stage Application of International Application No. PCT/EP2019/072106 filed Aug. 19, 2019, which was published in English on Feb. 27, 2020 as International Publication No. WO 2020/038869 A1. International Application No. PCT/EP2019/072106 claims priority to European Application No. 18190087.9 filed Aug. 21, 2018.

The present invention relates generally to an apparatus for crimping a band of material, and to a method of crimping and shaping a sheet of material. In particular but not exclusively, the present invention relates to an apparatus for crimping a band of material for use in a smoking article.

In the tobacco industry, rollers are used in a material crimping process. In such a process, a band or sheet of material S' (for example in the form of a tobacco cast leaf band (TCL) or a sheet of polylactic acid (PLA)) is passed between first and second crimper rollers 302, 303 of a crimping apparatus 300 (as shown in FIG. 1). The crimper rollers 302, 303 each have a first end 302*a*, 303*a*, a second end 302*b*, 303*b* and a longitudinal rotational axis A', B' extending therebetween. The rollers 302, 303 are each driven to contra-rotate. That is, the first crimping roller 302 rotates in a first direction and the second crimping roller 303 in a second, opposite direction (as indicated by the arrows in FIG. 1).

Typically, each of the crimper rollers 302, 303 has a pattern formed on its circumferential working surface. The patterns are configured to cooperate with one another, in use. For example, a pattern of grooves on the circumferential working surface of the first crimper roller 302 may be configured to cooperate with a pattern of ridges on the circumferential working surface of the second crimper roller 303. In use, the first and second crimper rollers 302, 303 are arranged such that the pattern on one cooperates with the pattern on the other, to thereby crimp the sheet of material S' passed therebetween. On crimper rollers 302, 303 for use in the tobacco industry, the patterns, for example, the plural grooves and ridges, on the respective circumferential working surfaces are typically formed by features on a micron scale. Meanwhile, the sheet of material S' may be relatively thin.

Following crimping, the band of material is typically passed towards and through a further apparatus related to the processing of the crimped band, for example a shaping apparatus 310, as shown in FIG. 2. The crimped band is fed into the shaping apparatus, which compresses the band inside a funnel-like device down to a desired diameter, wraps it into a continuous cylinder and cuts it into discrete sticks of TCL or PLA. Such a process may be used to make 'rods' for Heat-Not-Burn smoking articles or filters for convention cigarettes.

The crimping rollers pull the band of material from bobbins, located upstream of the crimping rollers. The band of material (and the resulting continuous cylinder) is also pulled through the shaping apparatus, typically via a garniture tape. Although the speeds of these systems during start-up is fixed, speed differences may arise between the two systems during use, for example when the bobbin supplying the band of material is changed. In particular speed differences could arise between the exit of the crimping rollers and the entrance of the funnel of the shaping apparatus. Such speed differences may result in variations in the tension of the band of material, despite the use of buffer systems to reduce this effect. Tension variations in the band of material may result in inconsistencies within the final product, for example, the compression of the band within the shaping apparatus may be impacted, affecting the Resistance To Draw (RTD) and the overall functionalities of the material within the rod or filter.

A known way to regulate the tension in the band of material between a crimping apparatus and a shaping apparatus is to provide a tensioning roller (a 'dancer') between the crimping apparatus and the tensioning roller. Such a roller acts as a rotating lever pressing on the band of material, with the rotation of the lever (and so the pressure exerted by the roller on the band) being controlled and exerted by a spring. However, the use of such a tensioning roller can be relatively ineffective and complicated, requiring speed adjustment of the crimping rollers as the tensioning roller adjusts the band tension.

US20170245542A1 discloses an apparatus for and a method of manufacturing a crimped web for an aerosol-generating article.

US20140166032A1 discloses a rod for use in a smoking article, the rod including a gathered sheet of homogenised tobacco material circumscribed by a wrapper.

WO2017089545A1 discloses a homogenized tobacco sheet production line.

US4618339A discloses an apparatus for conditioning filter tow for subsequent production of cigarette filter rod.

US5466209A discloses an automatized weight-control device for filter-rods.

It would be desirable to provide an apparatus for crimping a band of material and a method of crimping a band of material, which overcomes the above problems.

According to a first aspect of the invention there is provided an apparatus for crimping a band of material, the apparatus comprising:

- a crimping portion comprising a first crimping roller defining a first rotational axis and a second crimping roller defining a second rotational axis, wherein the first and second crimping rollers are configured to allow a band of material to pass therebetween and out in a desired direction; and
- an adjustment portion configured to adjust the position of at least one of the first and second rotational axes relative to the position of the adjacent apparatus to thereby adjust the position or angle or both the position and angle of the band of material between the crimping portion and the desired direction.

To adjust the position or angle (or both) of the band of material is to adjust the tension of the band of material from the crimping portion. It may be to adjust the tension between the crimping portion and a predetermined location. The predetermined location may be the next consequential step in the process, adjacent apparatus, anything able to support or hold the band of material.

Aptly, the desired direction can be any angle from the crimping portion including partially wrapping around one of the crimping rollers.

Aptly, the desired direction can be 0 to 180 degrees, aptly 10 to 170 degrees or 30 to 150 degrees from a crimping position of the crimping portion, measured from a line joining the axes of the two crimping rollers.

Aptly, the desired direction is towards a predetermined location, for example the next step in the process, or adjacent apparatus. That is, according to an aspect of the invention there is provided an apparatus for crimping a band of material, the apparatus comprising:

- a crimping portion comprising a first crimping roller defining a first rotational axis and a second crimping roller defining a second rotational axis, wherein the first and second crimping rollers are configured to allow a band of material to pass therebetween and towards a predetermined location; and an adjustment portion configured to adjust the position of at least one of the first and second rotational axes relative to the predetermined location to thereby adjust the tension in the band of material between the crimping portion and the predetermined location.

Aptly, the predetermined location is the location of an adjacent apparatus. That is, according to an aspect of the invention there is provided an apparatus for crimping a band of material, the apparatus comprising:

a crimping portion comprising a first crimping roller defining a first rotational axis and a second crimping roller defining a second rotational axis, wherein the first and second crimping rollers are configured to allow a band of material to pass therebetween and towards an adjacent apparatus; and an adjustment portion configured to adjust the position of at least one of the first and second rotational axes relative to the position of the adjacent apparatus to thereby adjust the tension in the band of material between the crimping portion and the adjacent apparatus.

Aptly, the first and second crimping rollers are rotatable about the first and second rotational axis respectively.

Aptly, the adjustment portion is configured such that as the position of at least one of the first and second rotational axes is adjusted relative to the position of the predetermined location (or the adjacent apparatus), the length of the path taken by the band between a crimping position and the predetermined location (or the adjacent apparatus) is also adjusted.

Aptly, the adjustment portion is configured to adjust the position of the second rotational axis relative to the first rotational axis to thereby adjust the tension in the band of material.

Aptly, the adjustment portion includes an adjustment plate, coupled to the first and second crimping roller, wherein the adjustment plate is configured to rotate to thereby adjust the position of at least one of the first and second rotational axis relative to the position of the predetermined location (or the adjacent apparatus).

Aptly, the first and second crimping roller extend substantially perpendicularly from the adjustment plate.

Aptly, the adjustment plate defines a plane, the adjustment plate being rotatable about a third rotational axis perpendicular to the plane.

Aptly, the third rotational axis is coincident with the first rotational axis, such that the second crimping roller is configured to rotate about the third rotational axis as the adjustment plate is rotated about the third rotational axis.

Aptly, the adjustment portion is configured to translate the first and second rotational axis relative to the predetermined location (or the adjacent apparatus) to thereby adjust the tension in the band of material.

Aptly, the translation of the first and second axes relative to the predetermined location (or the adjacent apparatus) is in a direction substantially perpendicular to the first and second axes.

Aptly, the translation of the first and second rotational axes relative to the predetermined location (or the adjacent apparatus) is in a substantially vertical direction.

Aptly, the adjustment portion includes at least one tension sensor configured to measure the tension in the band between the crimping portion and the predetermined location (or the adjacent apparatus).

Aptly, the adjustment portion is configured to adjust the tension in the band in response to the tension sensed by the tension sensor.

According to a second aspect of the invention there is provided a system for crimping and shaping a band of material, the system comprising:

an apparatus for crimping a band of material, the apparatus comprising:

a crimping portion comprising a first crimping roller defining a first rotational axis and a second crimping roller defining a second rotational axis; and an adjustment portion; and a shaping apparatus for shaping a band of material;

wherein the first and second crimping rollers are configured to allow a band of material to pass therebetween and towards and through the shaping apparatus, and wherein the adjustment portion is configured to adjust the position of at least one of the first and second rotational axes relative to the position of the shaping apparatus to thereby adjust the tension in the band of material between the crimping portion and the shaping apparatus.

According to a third aspect of the invention there is provided a method of crimping and shaping a band of material, the method comprising:

providing a system comprising:

an apparatus for crimping a band of material, the apparatus comprising:

a crimping portion comprising a first crimping roller defining a first rotational axis and a second crimping roller defining a second rotational axis; and an adjustment portion; and a shaping apparatus for shaping a band of material; and passing a band of material between the first and second crimping rollers and towards and through the shaping apparatus;

adjusting the position of at least one of the first and second rotational axes relative to the position of the shaping apparatus to thereby adjust the tension in the band of material between the crimping portion and the shaping apparatus.

The method of the third aspect can be used with any of the apparatus or system features described in relation to the first and second aspects.

Certain embodiments of the invention provide the advantage that an apparatus is provided for crimping a band of material, where the apparatus can adjust the tension of the band. By allowing the adjustment (and hence regulation) of the tension of the band, the apparatus can be used to produce a more consistent product compared to known apparatus.

As used herein, the term 'translate' is used to describe a movement of an entity, where every point of the entity is moved by the same distance in a given direction. That is, the translation of an axis relative to an adjacent apparatus, involves the movement of every point of the axis in a given direction relative to the adjacent apparatus (in other words, without changing the orientation of the axis relative to the adjacent apparatus).

As used herein, the term 'tension' is used to describe a tensile or pulling force. When referring to a band of material, the tension is the axial tensile or pulling force within the band of material. That is, the tension is the degree to which the band of material is being pulled axially.

As used herein, the term 'crimping' is used to describe processing a band of material in order to form a crimped band of material comprising plural corrugations or ridges and grooves. When using a pair of rollers for crimping, the processing comprises passing the sheet of material between the pair of rollers and forming the corrugations or ridges and grooves in or on the crimped sheet.

As used herein, the term 'crimping portion' is used to describe a portion of apparatus configured for crimping a band of material.

As used herein, the term 'crimping position' is used to describe the position at which the band of material is crimped. Specifically, the crimping position of the crimping portion is the position at which the band of material is squeezed and hence crimped between crimping rollers.

As used herein, the term 'crimping roller' is used to describe to a generally cylindrical body, extending from a first end to a second end, and having a substantially cylindrical circumferential working surface. The circumferential working surface is generally parallel to the longitudinal axis extending between the first and second ends of the roller. The circumferential working surface of at least one roller preferably includes a pattern formed on the circumferential working surface. The pattern preferably includes a raised pattern including, for example a plurality of ridges with grooves therebetween. The raised pattern preferably includes features of a micron scale.

As used herein, the term 'adjacent apparatus' is used to describe an apparatus located directly downstream/upstream relative to the crimping apparatus in the system/production line. For example, in the described examples below the adjacent apparatus is a shaping apparatus located downstream of the crimping apparatus in a system for crimping and shaping a band of material.

As used herein, the term 'shaping apparatus' is used to describe an apparatus for shaping or gathering a band of material. For example, the shaping apparatus may be configured to shape a band of material into a rod or filter. The shaping apparatus may include a funnel element for gradually compressing the band of material to a desired diameter.

As used herein, the term 'adjustment portion' is used to describe a portion of apparatus configured to adjust tension in a band of material. The adjustment portion adjusts the position of the rotational axes of at least one of the crimping rollers relative to the shaping apparatus or adjacent apparatus. As such, the distance between an exit point of the crimping rollers and the shaping apparatus or adjacent apparatus may be adjusted to thereby adjust tension in a band of material extending between the crimping portion and the shaping apparatus or adjacent apparatus.

For the avoidance of doubt, any of the features described herein apply equally to any aspect of the invention. Within the scope of this application it is expressly envisaged that the various aspects, embodiments, examples and alternatives set out in the preceding paragraphs, in the claims or in the following description and drawings, and in particular the individual features thereof, may be taken independently or in any combination. Features described in connection with one aspect or embodiment of the invention are applicable to all aspects or embodiments, unless such features are incompatible.

The invention will now be further described, by way of example only, with reference to the accompanying drawings, in which.

Figure 1:
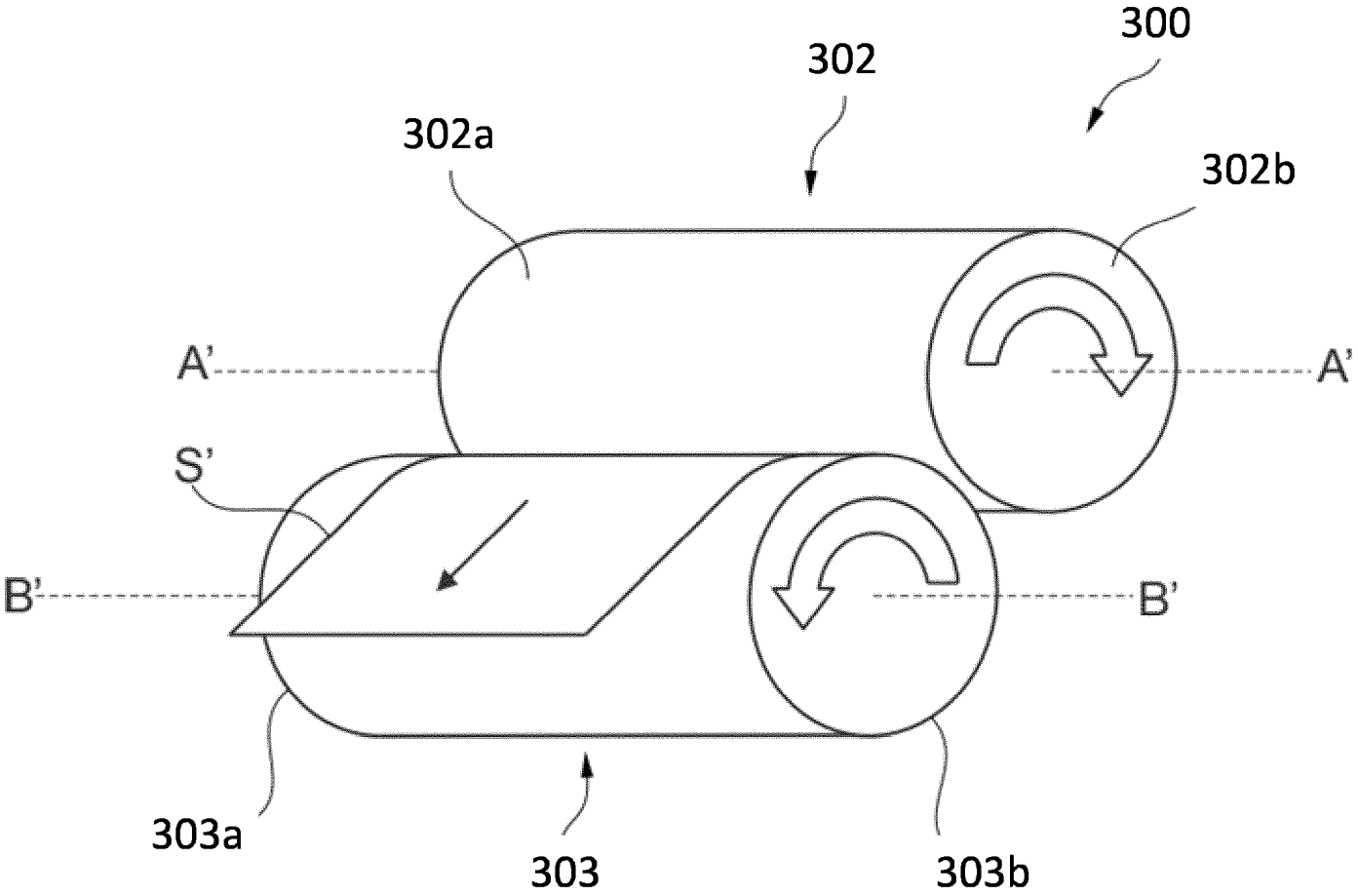
Prior art Fig. 1
FIG. 1 illustrates a schematic perspective view of a pair of prior art rollers crimping a band of material.
Figure 2:
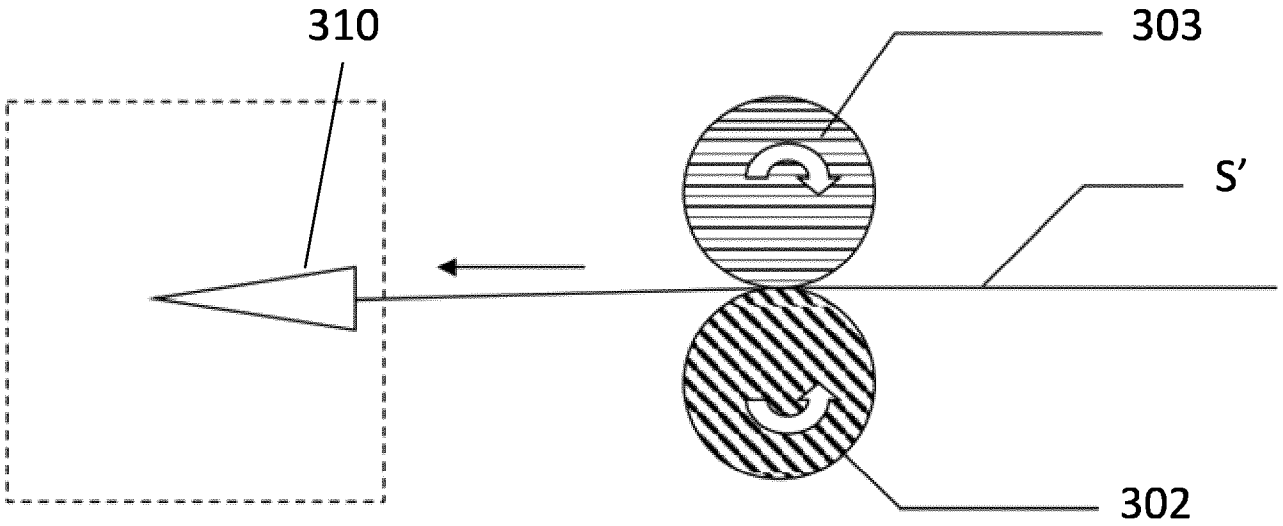
Prior art Fig. 2
FIG. 2 illustrates a schematic perspective view of a prior art apparatus for crimping and shaping a band of material.
Figure 3:
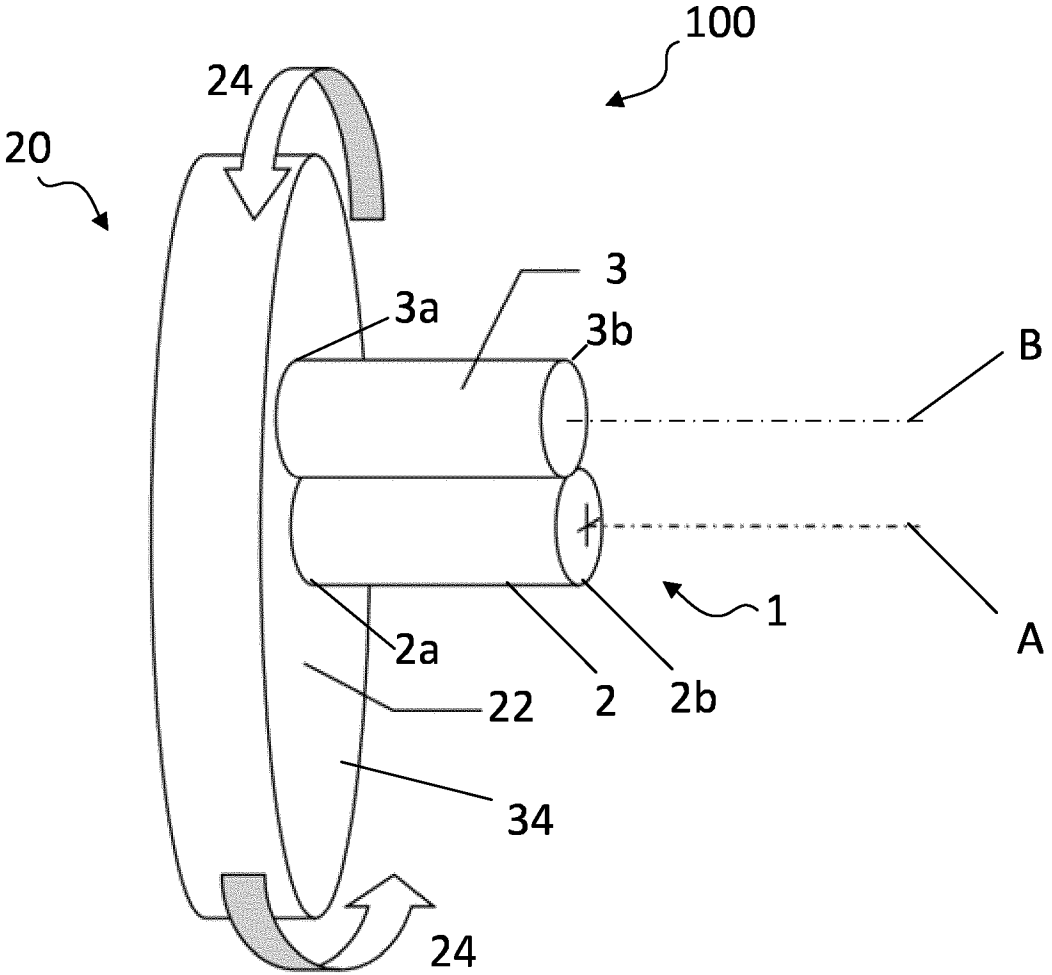
FIG. 3 illustrates a schematic perspective view of an apparatus for crimping a band of material.
Figure 4B:
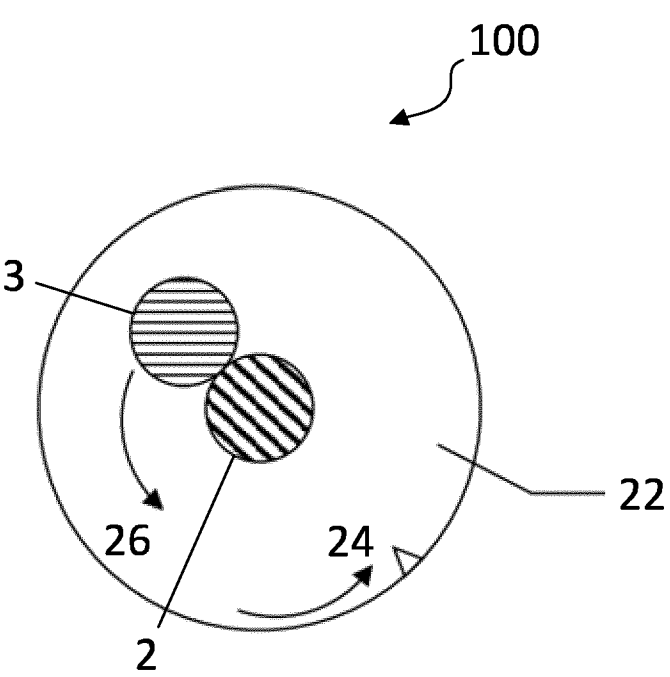
Figure 4A:
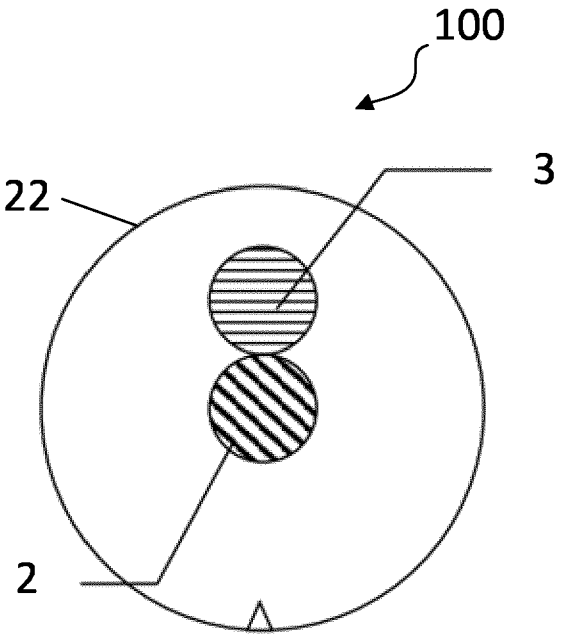
Figure 5A:
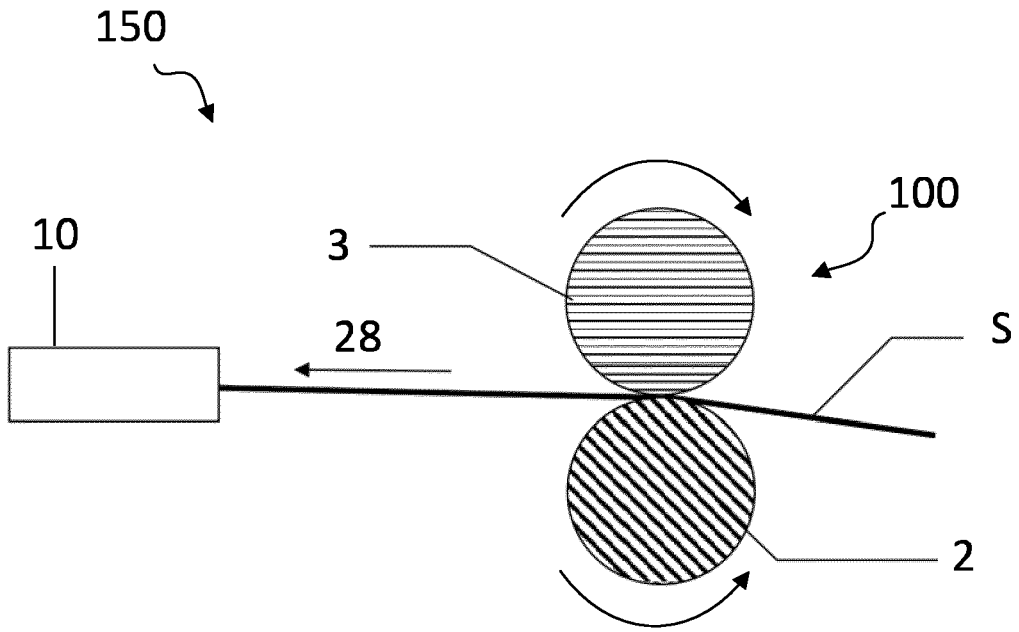
Figure 5B:
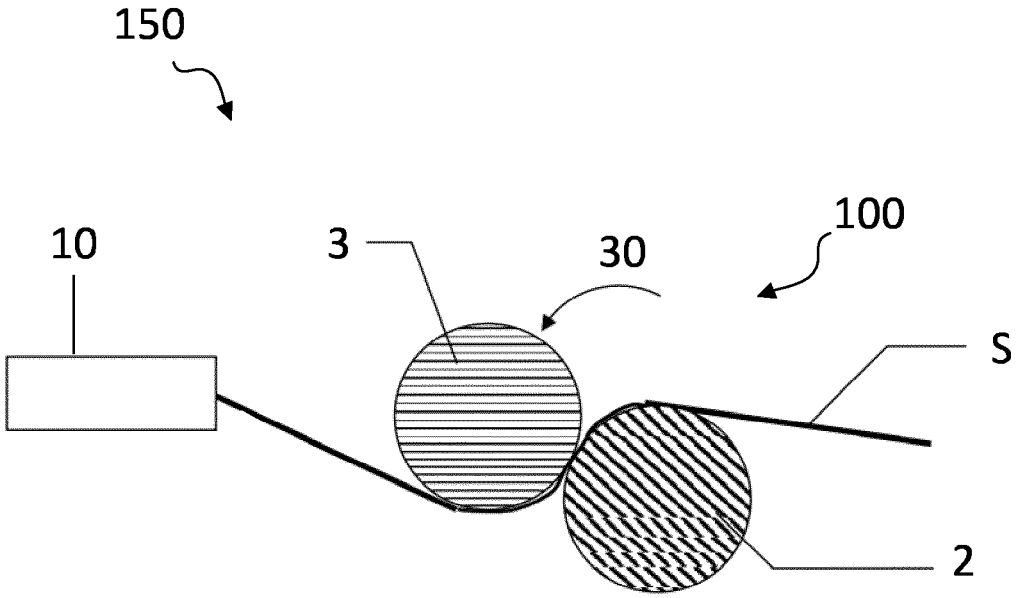
Figure 6A:
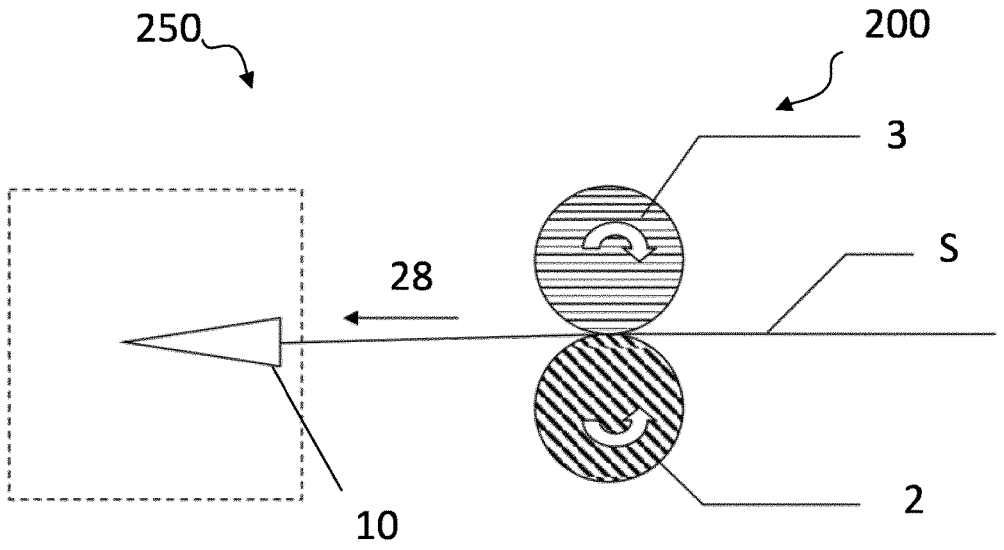
Figure 6B:
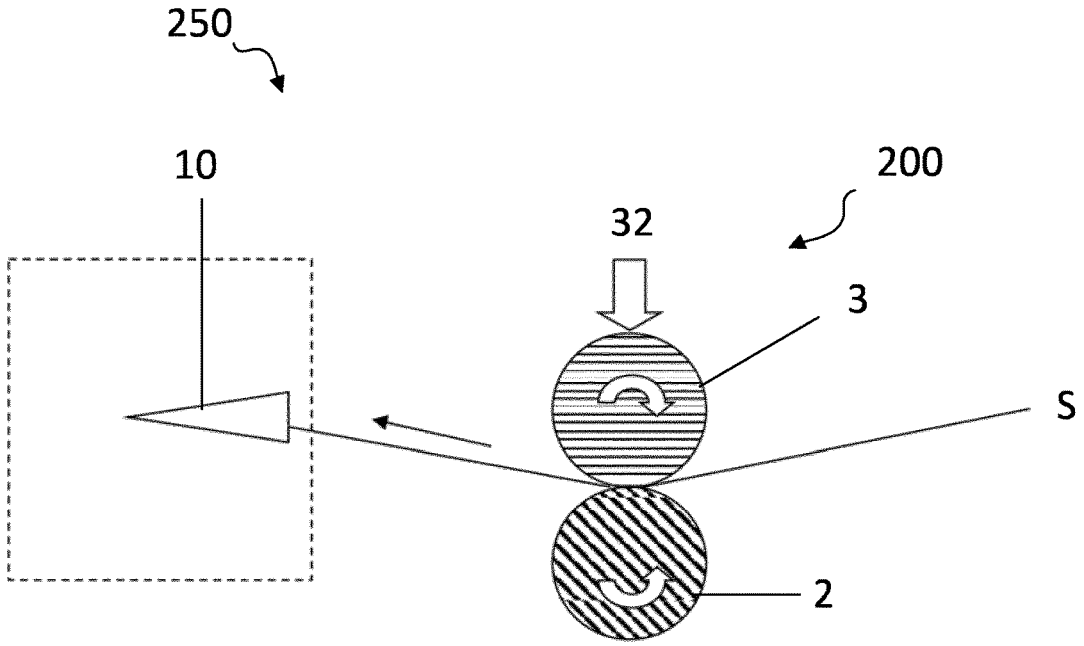

FIGS. 4*a* and 4*b* illustrate side views of the apparatus of FIG. 3 in first and second rotational positions;

FIGS. 5*a* and 5*b* illustrate a side view of a system for crimping and shaping a band of material, including the apparatus of FIG. 3 in first and second rotational positions respectively; and FIGS. 6*a* and 6*b* illustrate a side view of an alternative system for crimping and shaping a band of material in first and second operational configurations respectively.

Referring now to FIG. 3, there is shown an apparatus 100 for crimping a band of material according to a first embodiment. The apparatus 100 includes a crimping portion 1 including a first crimping roller 2 defining a first rotational axis A and a second crimping roller 3 defining a second rotational axis B. The first and second crimping rollers 2,3 are configured to allow a band of material to pass therebetween and towards an adjacent apparatus. Each of the first and second crimper rollers 2, 3 comprise a circumferential working surface which may include a pattern for patterning a sheet material passing therebetween. The first and second crimping rollers 2,3 are rotatable about the first and second rotational axis respectively. In this example, the first and second rotational axes A,B are parallel.

The apparatus 100 further includes an adjustment portion 20 configured to adjust the position of at least one of the first and second rotational axes A,B relative to the position of the adjacent apparatus to thereby adjust the tension in the band of material between the crimping portion 1 and the adjacent apparatus.

In this example, the adjustment portion 20 includes an adjustment plate 22, coupled to the first and second crimping rollers 2,3. The first and second crimping roller 2,3 extend substantially perpendicularly from the adjustment plate 22. Specifically, the adjustment plate 22 defines a plane (in other words. in this example on a front surface 34 thereof) with the first ends 2*a*,3*a* of the first and second crimping rollers 2,3 being proximate to the adjustment plate 22 and the second ends 2*b*, 3*b* being distal to the adjustment plate 22, such that the longitudinal rotational axes A,B are normal (perpendicular) to the plane of the adjustment plate 22.

The first and second crimping rollers 2,3 are rotatably mounted to the adjustment plate, such that the first and second crimping rollers 2,3 can rotate around the first and second rotational axes respectively. For example, the axis of each of the crimping rollers 2,3 may extend into the adjustment plate to enable rotational movement of each crimping roller 2,3 about its respective axis A,B. In this example, the crimping portion 100 further includes drive means (not shown) for driving the rotation of the first and second crimping rollers 2,3. In this example the drive means includes separate motors for each of the first and second crimping rollers 2,3. In this example, the drive means are located within the adjustment plate 22.

The adjustment plate 22 is rotatable about a third rotational axis perpendicular to the plane (in other words front surface 34) of the adjustment plate. In this example, the adjustment portion 20 further includes drive means (not shown) for driving the rotation of the adjustment plate 20 around the third rotational axis. In this example, the drive means is a motor.

In this example, the second crimping roller 3 is configured to rotate about the third rotational axis as the adjustment plate 22 is rotated about the third rotational axis. That is, the relative distance between the rotational axis of the second crimping roller 3 and the rotational axis of the adjustment plate 22 is fixed (by virtue of the second crimping roller being mounted to the adjustment plate 22). In other words the rotational axis of the second crimping roller 3 is offset from the third rotational axis (the adjustment plate rotational axis).

FIGS. 4*a* and 4*b* illustrates the apparatus 100 in first and second rotational positions respectively. That is, FIG. 4*a* illustrates the apparatus 100 in an initial position prior to a rotation of the adjustment plate (a neutral position). FIG. 4*b* illustrates the apparatus 100 following an anti-clockwise rotation of the adjustment plate about the third rotational axis (as indicated by arrows 24). In this example, the third rotational axis is coincident with the first rotational axis. In other words, the first crimping roller is coaxial with the adjustment plate. In this manner, the second crimping roller 3 is configured to rotate about the first crimping roller (or specifically the first rotational axis thereof) as the adjustment plate 22 is rotated about the third rotational axis, as indicated by the arrow 26 in FIG. 4*b*. It will be appreciated that the second crimping roller 3 also rotates about the third rotational axis.

The apparatus 100 is configured to form part of a system 150 for crimping and shaping a band of material in use, as shown in FIGS. 5*a* and 5*b*. The system includes the apparatus 100 and an adjacent apparatus 10 (or 'next stage apparatus', i.e. an apparatus that receives the band of material from the apparatus 100). In this example, the band of material is a band of TCL or PLA, to be converted into TCL or PLA sticks for use as consumables in Heat not Burn devices. In other examples the band of material may be a filter material to be converted into a filter for a convention cigarette. In this example, the adjacent apparatus 10 is a shaping apparatus for shaping a band of material S.

FIG. 5*a* illustrates the system 150 in a first operational configuration. We note that the adjustment portion 20 of the apparatus 100 is not shown in FIGS. 5*a* and 5*b* for clarity. In this example the band of material S is provided on a bobbin (not shown). The band of material S is passed between the first and second crimping rollers 2,3 and towards and through the shaping apparatus 10. In this example, as the band of material is passed between the crimping rollers 2,3, the band engages with the working surface of both rollers at a crimping position. That is, the crimping position of the crimping portion is the position at which band of material S is squeezed and hence crimped between both crimping rollers 2,3. In other words, the band of material is effectively held between the crimping rollers 2,3 at the crimping position.

The first and second crimping rollers 2,3 are each driven to contra-rotate (as indicated by the arrows in FIG. 5*a*). In other words, the first and second crimping rollers 2,3 rotate in opposite directions to enable passage of the band of material S therethrough in the direction illustrated by the arrow 28.

During operation, the crimping rollers are driven and the rotation of the crimping rollers 2,3 pulls the band of material S from the bobbin. The shaping apparatus is also driven (as per known shaping apparatus) and pulls the band from the crimping rollers, such that the band of material travels in the direction of arrow 28 (which in this example is in a substantially horizontal direction). The band of material is crimped (or patterned) as it contacts the working surfaces of the first and second crimping rollers 2,3 at the crimping position. As a result of the band being pulled by the shaping apparatus and crimped by the crimping portion a tension is generated along the length of the band between the position of crimping and the shaping apparatus.

In the first operational configuration of FIG. 5*a*, the apparatus 100 is in the first rotational position (neutral position) as shown in FIG. 4*a*. In use, the position of the second rotational axis relative to the position of the shaping apparatus is adjustable to thereby adjust the tension in the band of material S between the crimping portion and the shaping apparatus 10.

FIG. 5*b* illustrates the system in a second operational configuration, in which the tension of the band S has been varied from that in the first operational configuration by rotation of the adjustment plate. In the configuration of FIG. 5*b* the apparatus is in a rotational position substantially corresponding to the second rotational position as shown in FIG. 4*b*. Specifically, the second crimping roller 3 has rotated around the third rotational axis, which in this example corresponds to a rotation around the rotational axis of the first crimping roller 2 (as indicated by arrow 30). That is, the adjustment portion 20 has adjusted the position of the second rotational axis relative to the first rotational axis to thereby adjust the tension in the band of material (by virtue of the first and third rotational axis being coaxial).

The change in the tension of the band between the crimping portion and the adjacent apparatus is driven by a change in the distance of the path taken by the band between the crimping position of the crimping portion (at which the band is crimped) and the position of the shaping apparatus.

Specifically, at a given moment (in other words for a stationary band), the section of the band between the crimping position and the shaping apparatus is effectively fixed. That is, an end of the section of band is held between the crimping rollers at the crimping position and an opposing end of the section of band is held by the shaping apparatus. An adjustment in the distance of the path taken by the section of band between the crimping position and the shaping apparatus (in other words between the fixed ends) results in a change in length of the section of band. This generates a change in the tension in the band between the crimping position and the shaping apparatus.

In this example as the second rotational axis is rotated around the first crimping roller, the second crimping roller acts to displace part of the band from the path 28 from the crimping portion to the shaping apparatus. In doing so the length of the section of band between the crimping position and the shaping apparatus changes (in this example increases) and hence the tension also changes (in this example increases). Specifically, in this example, the band is forced around part of the circumference of the second crimping roller, which increases the length of the path.

In this example, the system is brought from the first operational configuration to the second operational configuration during use, in other words as the crimping rollers 2,3 are rotating around their respective axis and hence undertaking a crimping operation.

FIGS. 6*a* and 6*b* illustrate an apparatus 200 (shown as part of a system 250) according to a second embodiment. The apparatus 200 has corresponding features to the apparatus 100, with corresponding features being labelled in the same manner. The adjustment portion 20 is not shown for figure clarity. FIG. 6*a* illustrates the system 250 in a first operational configuration, with the crimping rollers 2,3 (or specifically the first and second rotational axes thereof) in a first location relative to the shaping apparatus 10.

In this example, the adjustment portion 20 is configured to translate the first and second rotational axis relative to the adjacent apparatus (in this example shaping apparatus 10) to thereby adjust the tension in the band of material. The adjustment portion 20 may translate the first rotational axis and second rotational axis in any suitable manner. For example, the adjustment portion 20 may itself be translated via rails and a system of pulleys.

FIG. 6*b* illustrates the system 250 following translation of the first and second rotational axes to adjust the tension in the band of material. In this example, the translation of the first and second axes relative to the shaping apparatus 10 is in a direction substantially perpendicular to the first and second axes. In particular, the translation of the first and second rotational axes relative to the shaping apparatus is in a substantially vertical direction as indicated by the arrow 32.

In the same manner as discussed for the previous embodiment, the translation of the first and second rotational axes relative to the shaping apparatus (in other words translation of the first and second crimping rollers 2,3) displaces the crimping position of the band relative to the shaping apparatus. In doing so the path of the band between the crimping position and the shaping apparatus and the hence the length of the section of band between the crimping position and the shaping apparatus changes (in this example increases). As a result the tension also changes (in this example increases). In both examples described above the adjustment portion 20 includes at least one tension sensor (not shown) configured to measure the tension in the band between the crimping portion and the shaping apparatus. In this example, the at least one tension sensor is an array of infrared sensors (not shown) positioned across the path of the band of material so that deviation of the band from an initial path (in other words following arrow 28 in this example) will indicate a change in tension of the band. Specifically, if the sensors were to indicate that the band was hanging below its initial position, this would be an indication that the band is too loose (in other words tension too low). Similarly, if the sensors were to indicate that the band was above the initial position, this would be an indication that the band is too tight (in other words tension too high). In alternative examples, any suitable tension sensor may be used. For example, the at least one tensor sensor may be a roller running on the band, the position of said roller being monitored to determine the tension in the band.

In the described examples, the adjustment portion 20 is configured to adjust the tension (regulate the tension) in the band in response to the tension sensed by the tension sensor. That is, for the first example the second rotational axis may be rotated (with respect to the shaping apparatus) by any amount that adjusts (either increases or decreases) the tension to the required level from the sensed tension.

Similarly, for the second example, the first rotational axis and second rotational axis may be translated by any amount that adjusts (either increases or decreases) the tension to the required level from the sensed tension.

In these examples the adjustment portion 20 includes a control unit (not shown) configured to process the signal from the tension sensor. The control unit is configured to instruct the adjustment portion on the required adjustment of the position of the first rotational axis or second rotational axis (or both first and second rotational axes) according to the signal received from the tension sensor.

Various modifications to the detailed arrangements as described above are possible. For example, the adjacent apparatus may be any suitable apparatus used in a production line following the crimping of a band of material.

The crimping may be partial or whole, that is the entire surface of the band of material may be crimped or only part of the surface. The crimping may use one roller or both, that is the circumferential working surface of one or both of the crimping rollers may include a crimping pattern. In the latter case, there may or may not be a complementary fit between the pattern on the working surface of the first crimping roller and the pattern on the working surface of the second crimping roller.

In alternative examples, the first and third rotational axes may not be coaxial. That is, the first rotational axis of the first crimping roller may be offset from the third rotational axis. For example both of the first rotational axis and second rotational axis may be offset from the third rotational axis. In such examples, the adjustment portion is configured to adjust the position of both the first and second rotational axes relative to the position of the adjacent apparatus to thereby adjust the tension in the band of material between the crimping portion and the adjacent apparatus. In such examples, the first crimping roller and the second crimping roller are configured to rotate about the third rotational axis as the adjustment plate is rotated about the third rotational axis. Such configurations may be preferred when a larger change in tension is required for a given rotation of the adjustment plate.

The first and second crimping rollers may be rotatably mounted to the adjustment plate in any suitable manner. For example, the first and second crimping rollers may be rotatably mounted to the adjustment plate via pins or screws or a via a bearing arrangement.

The adjustment plate may be made from any suitable material, for example metal (for example, stainless steel or aluminium) or plastic. In the described examples the adjustment plate is cylindrical, however any suitable shape may be used.

The plane of the adjustment plate 22, relative to which the third rotational axis is defined, may not be the front surface of the adjustment plate 22 as per the described examples. Alternatively, the plane of the adjustment plate 22, may be a cross-section through the adjustment plate 22.

Any suitable drive means may be used to drive the movement of crimping rollers and the adjustment plate. A single motor may be used for controlling both of the crimping rollers. Alternatively, only one crimping roller may be driven (in other words one active roller and one passive roller). The drive means for the first and second crimping rollers may be located anywhere, for example, mounted onto the adjustment plate, or between the adjustment plate and the crimping rollers.

The first and second crimping rollers 2,3 may have any suitable initial configuration to provide the initially desired tension in the band. That is the initial positions of the first and second crimping rollers relative to the shaping apparatus may not correspond to the 'first operational configuration' illustrated in FIGS. 5*a* and 6*a*. Instead an initial rotation/translation of the crimping rollers may be required to calibrate the initial tension in the band to the desired level.

The translation of the first and second rotational axes may be in any suitable direction to adjust the tension in the band. For example, the first and second rotational axes may be displaced up, down, left, right or any combination thereof (in the orientation shown in FIGS. 6*a* and 6*b*).

The band of material may not be 'effectively held' at the crimping position. Instead, the band of material may be effectively held at both the apparatus located upstream or downstream from the crimping apparatus. In this way a change in the path of the band of material results in change in tension between the upstream and downstream apparatus (and hence between the crimping apparatus and the downstream apparatus). Specifically, at a given moment (in other words for a stationary band), the section of the band between the upstream and downstream apparatus is effectively fixed.

That is, an end of the section of band is held at an apparatus upstream of the crimping apparatus (for example a bobbin) and an opposing end of the section of band is held by an apparatus downstream of the crimping apparatus (for example a shaping apparatus). An adjustment in the distance of the path taken by the section of band between the upstream and downstream apparatus' (in other words as a result of an adjustment of the crimping apparatus) results in a change in length of the section of band. This generates a change in the tension in the band between the upstream apparatus and the downstream apparatus (and hence generates a change in the tension in the band between the crimping position and each of the upstream and downstream apparatus).

A third embodiment may be implemented, combining the functionality of the first and second embodiments described above. That is, the adjustment portion can both rotate and translate the rollers. This embodiment is particularly effective at adjusting the tension of the band of material both upstream and downstream of the crimping apparatus.

The control unit may be configured to operate using a feedback system. For example, the control unit may instruct the adjustment portion to adjust the position of at least one of the first and second rotational axes and constantly compares the tension in the band (as sensed by the tension sensor) with a stored desired value (for example, a desired position or tension of the band).

The control unit may also be configured to control the rotational speed of the first or second (or both first and second) crimping rollers around the first and second rotational axis respectively. This can provide further adjustments to the tension in the band.

The control unit may be positioned relative to the apparatus in any suitable manner. For example, the control unit may be housed within the adjustment plate 22. Alternatively, the control unit may be located separately from the apparatus, for example to allow manual input.

The control unit may be coupled to the tension sensor and the driving means of the adjustment portion and crimping portion in any suitable manner. For example, the control unit may be coupled through a 'hard' connection, in other words through wiring. In another example the control unit may communicate with the tension sensor and adjustment portion by wireless communication means.

The control unit may be further configured to control one or more of the apparatus in the system. That is, the control unit may control the upstream and downstream adjacent apparatus. Specifically, the control unit may control relative speeds between adjacent apparatus, to help regulate the tension therebetween. In other words the control unit may control the rate at which the shaping apparatus pulls the band from the crimping rollers.

It will also be appreciated by those skilled in the art that any number of combinations of the aforementioned features and those shown in the appended drawings provide clear advantages over the prior art and are therefore within the scope of the invention described herein.

With the above described arrangements, the path length of the band between the crimping position and the shaping apparatus can be varied to a large range of configurations, such that a large range of tension adjustment is possible.

The use of a tension sensor allows the adjustment portion to adjust the tension in view of the actual tension in the band. This helps make the apparatus efficient.

The use of a control unit in combination with a tension sensor allows the process of monitoring and adjusting the tension in the band to the required level to be automated.

The schematic drawings are not necessarily to scale and are presented for purposes of illustration and not limitation. The drawings depict one or more aspects described in this disclosure. However, it will be understood that other aspects not depicted in the drawings fall within the scope of this disclosure.

The invention claimed is:

1. An apparatus for crimping a band of material, the apparatus comprising:

a crimping portion comprising a first crimping roller rotatable about a first rotational axis and a second crimping roller rotatable about a second rotational axis, wherein the first and second crimping rollers are configured to allow the band of material to pass between the first crimping roller and the second crimping roller and towards an adjacent apparatus, the band of material being crimped at a crimping position where the band of material is squeezed between the first crimping roller and the second crimping roller; and an adjustment portion configured to rotationally translate the position of at least one of the first and second rotational axes relative to the position of the other of the first and second rotational axes, or to translate the positions of both the first and second rotational axes relative to a position of the adjacent apparatus to thereby adjust the tension in the band of material between the crimping portion and the adjacent apparatus, wherein the adjustment portion is configured to adjust the tension in the band of material by adjusting the path length between the crimping position and the adjacent apparatus.

2. The apparatus as claimed in claim 1, wherein the first and second crimping rollers are rotatable about the first and second rotational axis respectively.

3. The apparatus as claimed in claim 1, wherein the adjustment portion is configured such that as the position of at least one of the first and second rotational axes is adjusted relative to the position of the adjacent apparatus, the length of the path taken by the band between a crimping position and the adjacent apparatus is also adjusted.

4. The apparatus as claimed in claim 1, wherein the adjustment portion is configured to adjust the position of the second rotational axis relative to the first rotational axis to thereby adjust the tension in the band of material.

5. The apparatus as claimed in in claim 1, wherein the adjustment portion includes an adjustment plate, coupled to the first and second crimping roller, wherein the adjustment plate is configured to rotate to thereby adjust the position of at least one of the first and second rotational axis relative to the position of the adjacent apparatus.

6. The apparatus as claimed in claim 5, wherein the first and second crimping roller extend substantially perpendicularly from the adjustment plate.

7. The apparatus as claimed in claim 5, wherein the adjustment plate defines a plane, the adjustment plate being rotatable about a third rotational axis perpendicular to the plane.

8. The apparatus as claimed in claim 7, wherein the third rotational axis is coincident with the first rotational axis, such that the second crimping roller is configured to rotate about the third rotational axis as the adjustment plate is rotated about the third rotational axis.

9. The apparatus as claimed in claim 1, wherein the translation of the first and second axes relative to the adjacent apparatus is in a direction substantially perpendicular to the first and second axes.

10. The apparatus as claimed in claim 1, wherein the translation of the first and second rotational axes relative to the adjacent apparatus is in a substantially vertical direction.

11. The apparatus as claimed in claim 1, wherein the adjustment portion includes at least one tension sensor configured to measure the tension in the band between the crimping portion and the adjacent apparatus.

12. The apparatus as claimed in claim 11, wherein the adjustment portion is configured to adjust the tension in the band in response to the tension sensed by the tension sensor.

13. A system for crimping and shaping a band of material, the system comprising:

an apparatus for crimping the band of material, the apparatus comprising:

a crimping portion comprising a first crimping roller rotatable about a first rotational axis and a second crimping roller rotatable about a second rotational axis; and an adjustment portion; and a shaping apparatus for shaping a band of material;

wherein the first and second crimping rollers are configured to allow the band of material to pass between the first crimping roller and the second crimping roller and towards and through the shaping apparatus, the band of material being crimped at a crimping position where the band of material is squeezed between the first crimping roller and the second crimping roller, and wherein the adjustment portion is configured to rotationally translate the position of at least one of the first and second rotational axes relative to the position of the other of the first and second rotational exes, or to translate the positions of both the first and second rotational axes relative to a position of the shaping apparatus to thereby adjust the tension in the band of material by adjusting a path length between the crimping position and the shaping apparatus.

14. A method of crimping and shaping a band of material, the method comprising:

providing a system comprising:

an apparatus for crimping the band of material, the apparatus comprising:

a crimping portion comprising a first crimping roller rotatable about a first rotational axis and a second crimping roller rotatable about a second rotational axis; and an adjustment portion; and a shaping apparatus for shaping the band of material, the band of material being crimped at a crimping position where the band of material is squeezed between the first crimping roller and the second crimping roller; and passing the band of material between the first and second crimping rollers and towards and through the shaping apparatus;

rotationally translating the position of at least one of the first and second rotational axes relative to the position of the other of the first and second rotational exes, or to translate the positions of both the first and second rotational axes relative to a position of the shaping apparatus to thereby adjust the tension in the band of material by adjusting a path length between the crimping position and the shaping apparatus.

* * * * *